US007874893B2

(12) United States Patent
Tashiro et al.

(10) Patent No.: US 7,874,893 B2
(45) Date of Patent: Jan. 25, 2011

(54) HONING METHOD AND HONING CONTROL DEVICE

(75) Inventors: Akiharu Tashiro, Yokohama (JP); Takayuki Monchujo, Yokohama (JP); Kiyohisa Suzuki, Ebina (JP); Jun Inomata, Yokohama (JP); Ryuji Fukada, Yokohama (JP); Eiji Shiotani, Kawasaki (JP); Daisuke Terada, Yokohama (JP); Kei Fujii, Warabi (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 425 days.

(21) Appl. No.: 12/133,407

(22) Filed: Jun. 5, 2008

(65) Prior Publication Data

US 2008/0305716 A1 Dec. 11, 2008

(30) Foreign Application Priority Data

Jun. 7, 2007 (JP) ..... 2007-151348
Feb. 12, 2008 (JP) ..... 2008-030572

(51) Int. Cl.
*B24B 49/00* (2006.01)
*B24B 1/00* (2006.01)
*B24B 7/00* (2006.01)
*B24B 9/00* (2006.01)
*G06F 19/00* (2006.01)

(52) U.S. Cl. ..... 451/5; 700/164; 451/8; 451/51; 451/159; 451/160

(58) Field of Classification Search ..... 700/164; 451/5, 8, 51, 159, 160
See application file for complete search history.

(56) References Cited

U.S. PATENT DOCUMENTS

| | | | | |
|---|---|---|---|---|
| 4,044,508 | A * | 8/1977 | Frederick | 451/27 |
| 5,800,252 | A * | 9/1998 | Hyatt | 451/61 |
| 6,910,945 | B2 * | 6/2005 | Suzuki et al. | 451/7 |
| 7,371,149 | B2 * | 5/2008 | Cloutier et al. | 451/5 |
| 2004/0109734 | A1 * | 6/2004 | Ooe et al. | 408/3 |
| 2005/0130560 | A1 * | 6/2005 | Klink et al. | 451/5 |
| 2008/0220696 | A1 * | 9/2008 | Cloutier et al. | 451/11 |

FOREIGN PATENT DOCUMENTS

JP HEI 5-277928 10/2002

* cited by examiner

*Primary Examiner*—Albert Decady
*Assistant Examiner*—Jason Lin
(74) *Attorney, Agent, or Firm*—Young Basile

(57) ABSTRACT

A honing method and honing control device suitable for the honing having a large processing area is provided. The honing control device includes a grinder and an expansion member for disposition in a processing hole of a workpiece. The amount of an expanding movement when the grinder contacts the inner surface of a gauge hole via the expansion member is stored as a target expansion amount by inserting a honing head into the gauge hole having the same size as a target processing diameter of a master gauge. Then, a honing of an inner surface of the processing hole is performed by inserting the honing head within a processing hole of a workpiece moving the grinder towards an outer side of a diametrical direction by the expansion member installed within the honing head to rotate the honing head. The honing is completed when the amount of the expanding movement of the grinder reaches a target expansion amount established by the master gauge.

15 Claims, 10 Drawing Sheets

HONING METHOD AND HONING CONTROL DEVICE

CROSS-REFERENCE TO RELATED APPLICATION

This application claims priority from Japanese Patent Application Serial Nos. 2007-151348, filed on Jun. 7, 2007, and 2008-030572, filed Feb. 12, 2008, each of which is incorporated herein in its entirety by reference.

TECHNICAL FIELD

The present invention relates to a method of precisely honing an inner surface of a cylinder and a honing control device.

BACKGROUND

Conventionally, it has been required to finish the roundness and cylindricity for processing diameter and shape of a cylinder bore of a cylinder block, for example, with high accuracy as it is a key part for determining engine performance. To this end, a honing method has been generally utilized as a final finish. Japanese Laid-Open Patent Publication No. (Hei) 5-277928 discloses a method for honing an inner surface of a cylinder wherein a bore diameter is continuously measured during processing. The process is completed upon reaching a predetermined bore diameter.

As taught therein, since the method measures the bore diameter during processing, an air micro gauge may be installed as a processing tool within a honing head. Further, as another method of measuring the bore diameter during processing, a plug gauge may be installed in the honing head.

BRIEF SUMMARY

Methods and devices for precisely honing a workpiece having a hole to be processed are disclosed herein. One method hones a workpiece having a hole to be processed by inserting a honing head with a grinder at an outer periphery thereof into the hole and moving the grinder towards an outer side of a diametrical direction of the honing head with an expansion member installed within the honing head to press an inner surface of the hole. The method comprises storing an amount of an expanding movement as a target expansion amount determined when the honing head is inserted into a gauge hole of a master gauge having a same size as a target processing diameter and the grinder contacts an inner surface of the gauge hole with the expansion member. The method according to this example also includes honing an inner surface of the hole by inserting the honing head into the hole, moving the grinder towards the outer side of the diametrical direction with the expansion member installed within the honing head, and rotating the honing head. Finally, the method according to this example includes completing the honing when a value obtained by subtracting an amount of an advancement of the grinder based on a distortion of the workpiece generated by a processing reaction force of the grinder against the hole from the amount of the expanding movement of the grinder reaches the target expansion amount established using the master gauge.

One example of a honing control device for performing a honing process wherein a honing head with a grinder at an outer periphery thereof is inserted into a hole of a workpiece and the grinder moves towards an outer side of a diametrical direction of the honing head with an expansion member installed within the honing head to press an inner surface of the hole includes means for detecting a processing reaction force of the grinder against the hole, the means installed on the honing head. This device also includes means for storing an amount of an expanding movement as a target expansion amount when the honing head is inserted into a gauge hole of a master gauge having a same size as a target processing diameter and the grinder contacts an inner surface of the gauge hole with the expansion member. Finally, the device in this example includes control means for determining a completion of the honing when a value obtained by subtracting an amount of advancement of the grinder based on a distortion along a radial direction of the workpiece generated by the processing reaction force from the amount of the expanding movement of the grinder reaches the target expansion amount established using the master gauge in the honing process wherein the honing head is inserted within the hole of the workpiece.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

According to methods of honing using the built-in air micro gauge, a back pressure of air exhausted via an air passage is detected wherein the air passage is installed in a guide pad contained within the honing head. Further, a gap formed between the guide pad and the cylinder bore is voltage-converted from the detected back pressure of air to thereby be converted to a cylinder bore diameter However, in such a measuring method, an upper limit for the gap and voltage-conversion is set. Thus, when the gap is excessively large (generally equal to or more than Φ0.1 mm), since the voltage-conversion cannot be accurately performed, the diameter cannot be measured. Consequently, such a method cannot be applied when a processing removal area by the honing is large.

Further, according methods of honing wherein the plug gauge is provided in the honing head, processing proceeds when putting a plug gauge portion in an upper end entry portion of a cylinder bore. Also, processing is completed when the plug gauge portion reaches a desired cylinder bore diameter wherein the plug gauge portion can be inserted within the cylinder bore. However, since the plug gauge contacts the cylinder bore, an inner surface of the cylinder bore may be damaged when inserting the plug gauge. In particular, when a thin coating layer is formed on a surface of the cylinder bore by thermal spray, such a method cannot be applied since the coating layer may be separated by inserting the plug gauge. Also, since only an upper portion of the cylinder bore is measured, a lower end of the cylinder bore is easily reduced and a measurement thereof cannot be performed when a processing area is large.

From the above, when the cylinder bore having a large processing area is honed, since it is necessary to prepare a plurality of honing heads with different processing diameters to thereby replace a tool with the honing head having a large processing diameter in every processing, it is necessary to provide a tool replacing function to a honing device or divide a processing station in each tool with a different diameter. Thus, the time lost for replacing a tool or installation investing costs may be increased.

In contrast, embodiments of the invention provide a honing method and a honing control device suitable for honing with a large processing area.

FIGS. 1 to 4 are initially described to illustrate a first embodiment of the honing method and honing control device of the invention.

Figure 1:
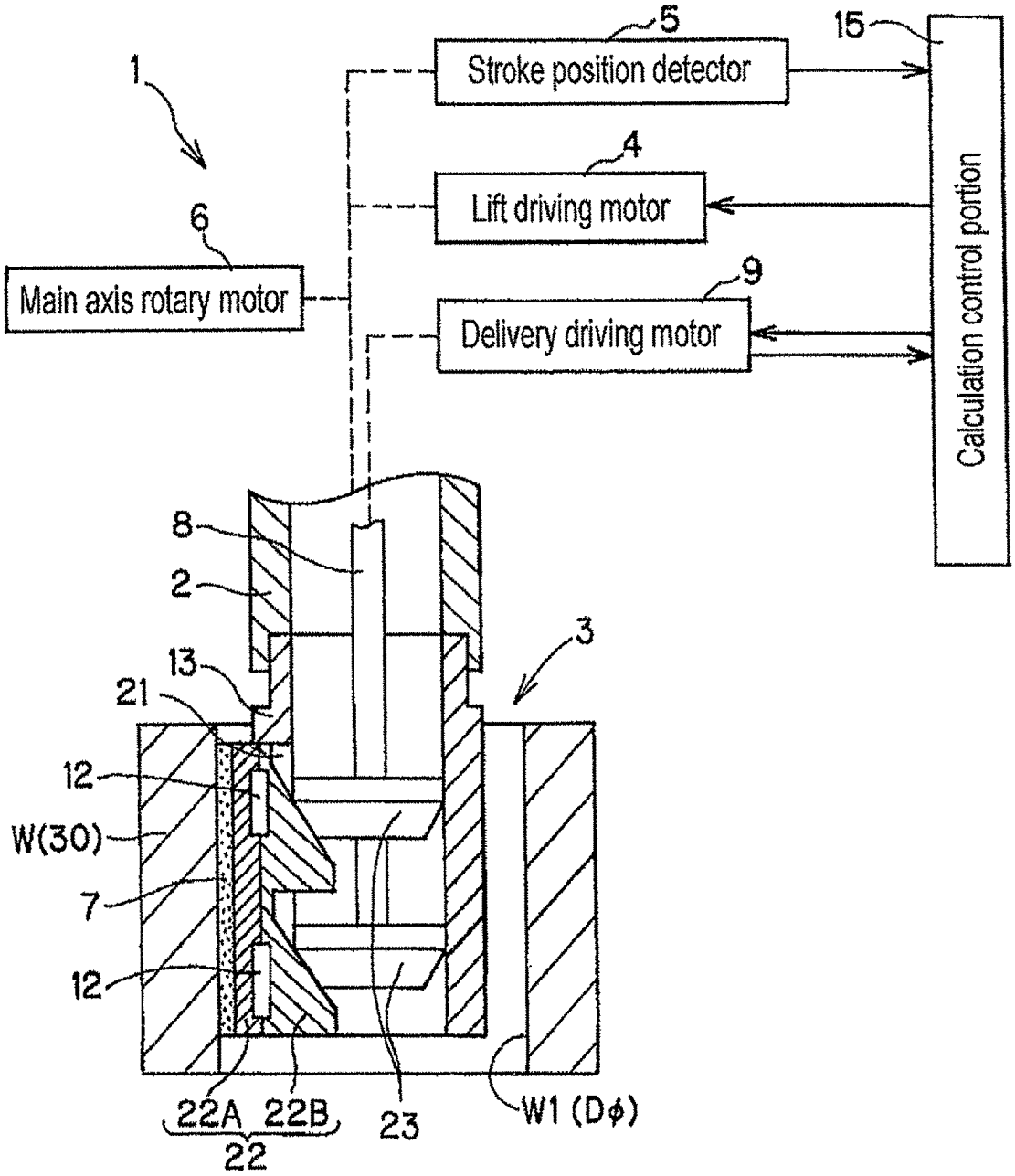
FIG. 1 is a system block diagram of a honing control device in accordance with an embodiment of the invention.
Figure 2:
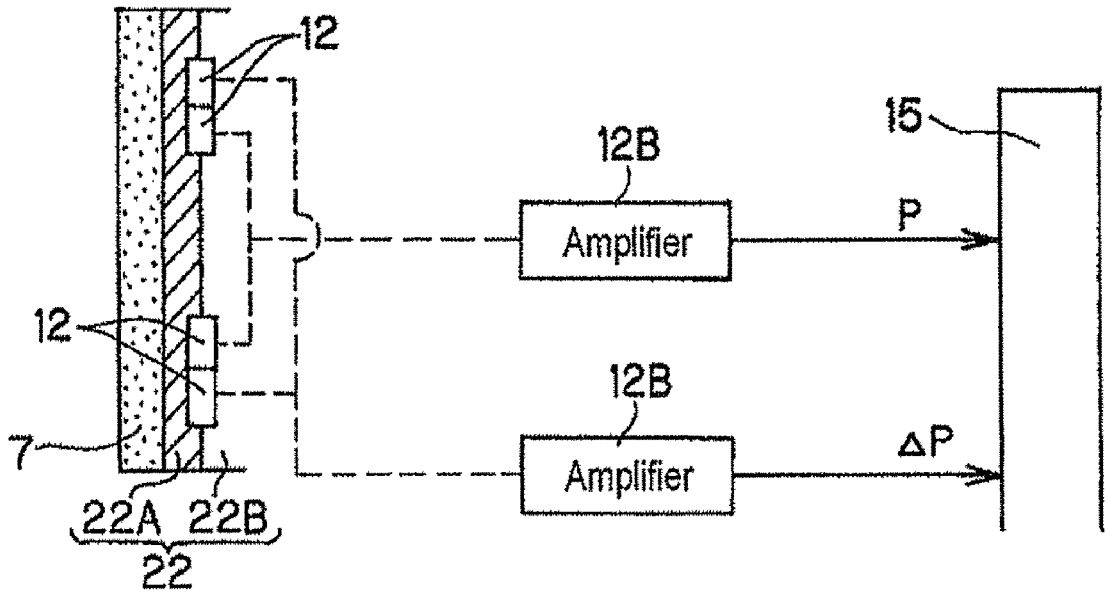
FIG. 2 is a system block diagram comprising a processing reaction force detecting device in accordance with an embodiment of the invention.

As shown in FIGS. 1 and 2, a honing control device 1 of the present embodiment comprises a honing head 3 arranged at a leading end of a driving tube 2 and inserted in a hole W1 to be processed formed in a workpiece W. A lift driving motor 4 lifts the honing head 3 by lifting the driving tube 2 and a stroke position detector 5 for detecting a lift position. A rotary driving motor 6 rotates the honing head 3 by rotating the driving tube 2. A delivery driving motor 9 is formed of a numerical-controlled servo motor for adjusting a radial position of a plurality of honing grinders 7 installed in the honing head 3, i.e., a delivery position obtained by lifting a push rod 8 within the driving tube 2. A processing reaction force sensor 12 such as a rod cell or piezo-element is used to measure the processing reaction force exerted to the honing grinder 7.

Each detecting signal of the stroke position detector 5 and the processing reaction force sensor 12 is input to a calculating control portion 15 acting as a controller. The calculation control portion 15 is configured to calculate control signals for each motor 5, 6 and 9 based on the input signals to output to a driving circuit (not shown) of each motor 5, 6 and 9. A delivery position of the delivery driving motor 9 is fed back to the calculation control portion 15 as the numerical control (NC) data, i.e., a reading position by a motor encoder contained therein. The calculation control portion 15 of the honing control device 1 is formed of a NC device for automatically controlling driving of the honing head 3 according to an input of processing command information displayed as numerical information. Such a NC device includes a motor control portion, the calculation control portion and an input portion.

The calculation control portion 15 generally controls the driving of the honing head 3, optimizing processing conditions such as rotation speed of the honing head 3, the lifting movement position and lifting speed of the honing head 3 and delivery amount and speed of the grinder 7 in a diametrical direction based on the processing command information input via the input portion as the numerical information. The calculation control portion 15 outputs a control signal to each motor control portion for driving the honing head 3 based on such processing conditions. In particular, regarding the delivery control of the grinder 7 in the diametrical direction, a movement target amount of the push rod 8 is established in consideration of an allowance along an up-down direction of a grinder rest 22 (an axial direction of the driving tube 2) within a grinder mounting hole 21 such that the grinder 7 is moved to an inner portion of the hole W1 to be processed with an optimized moving amount.

As shown in FIG. 1, the honing head 3 has a grinder holder 13 connected to the leading end of the driving tube 2.

The push rod 8 is inserted within the driving tube 2, and the push rod 8 is moveable by the delivery driving motor 9 along the axial direction (i.e., up-down direction) on a central axis of the driving tube 2.

A taper-shaped extrusion 23 is installed at a lower end portion of the push rod 8 in up-down two stages. A diameter of the taper-shaped extrusion 23 is reduced as it moves downwardly. To this end, a plurality of grinder mounting holes 21, which pass through along the diametrical direction, are provided at a side wall of a lower end of the driving tube 2, i.e., the grinder holder 13 when arranged to have the same interval along a peripheral direction. In the grinder mounting holes 21, the grinder rest 22 is mounted displaceable along the diametrical direction of the honing head 3, while the grinder 7 is fixed at an outer side end portion of each grinder rest 22. An inner side end portion of the grinder rest 22 has a taper shape in up-down two stages to thereby conform to the outer side end portion of the extrusion 23 in the up-down two stages. As the extrusion 23 is declined by the push rod, each grinder rest 22 is pushed by such an extrusion toward an outer side in the diametrical direction. Thus, a diameter of the grinder (i.e., a diameter of a circumcircle of the entire grinder 7) is expanded.

The grinder rest 22 is formed of an outer peripheral grinder rest 22A positioned at a radial direction outer side integrally fixed to the grinder 7 at an outer surface via bonding. An inner peripheral grinder rest 22B of the grinder rest 22 is incliningly coupled to the extrusion 23 in the up-down two stages. The processing reaction force sensor 12 is interposedly insertion-fixed between both grinder rests. The processing reaction force sensor 12 detects the processing reaction force F that the grinder 7 receives from a workpiece W. Further, a detected signal is input to the calculation control portion 15 after being amplified by an amplifier 12B as seen in FIG. 2.

The honing method by the honing control device 1 constructed as above is explained below based on the order of processing shown in FIG. 3. In the honing method according to the present embodiment, a master gauge 30 comprising a gauge hole Dϕ formed with the same diameter as a target processing diameter is previously manufactured as shown in FIG. 4. The target processing diameter of the honing control device is established in each processing cycle of the workpiece W by the master gauge 30. Further, an inner surface of a hole is honed to have the established target processing diameter.

Figure 3:
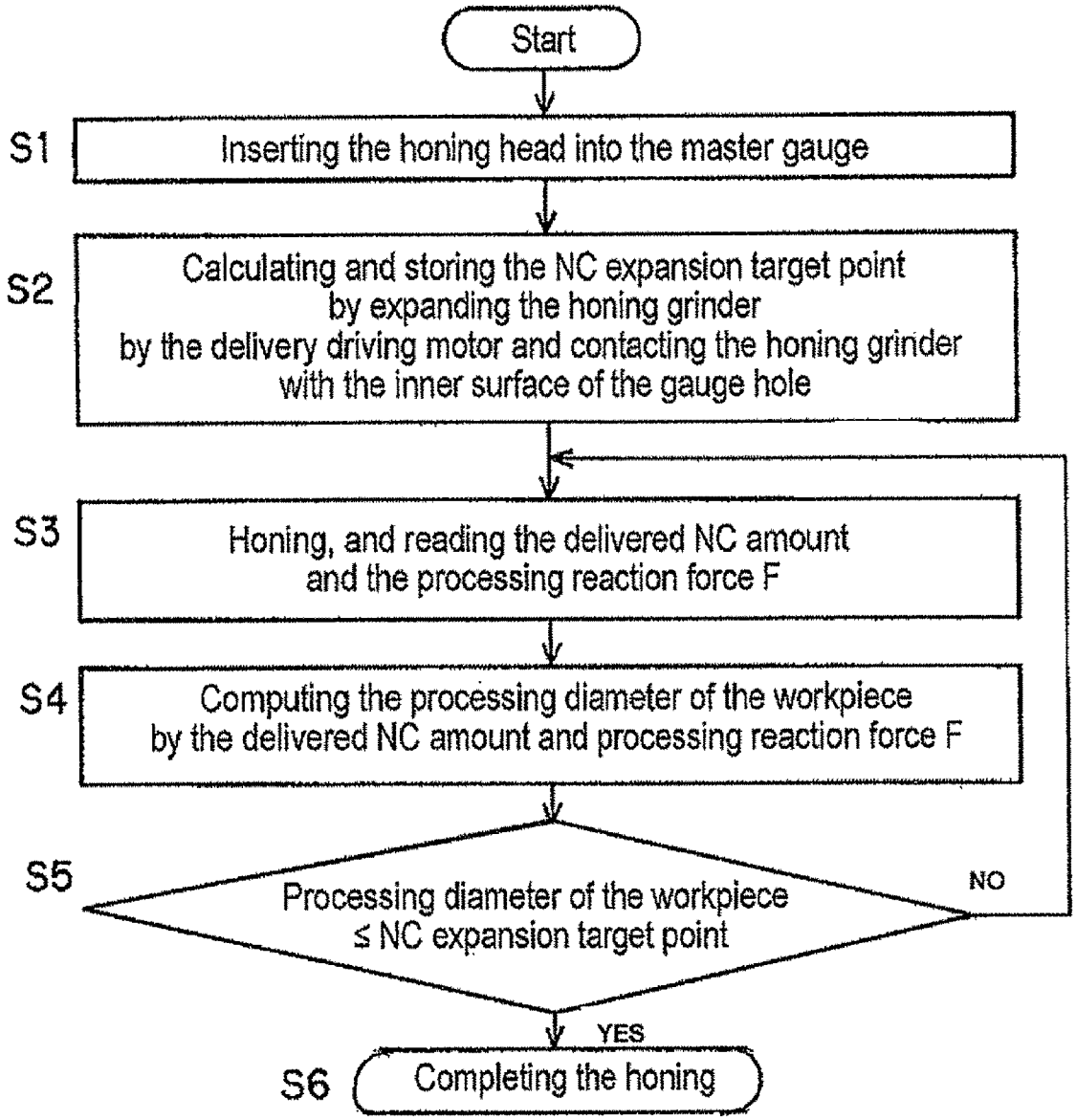
FIG. 3 is a flow chart showing the order of a honing method in accordance with an embodiment of the invention.
Figure 4:
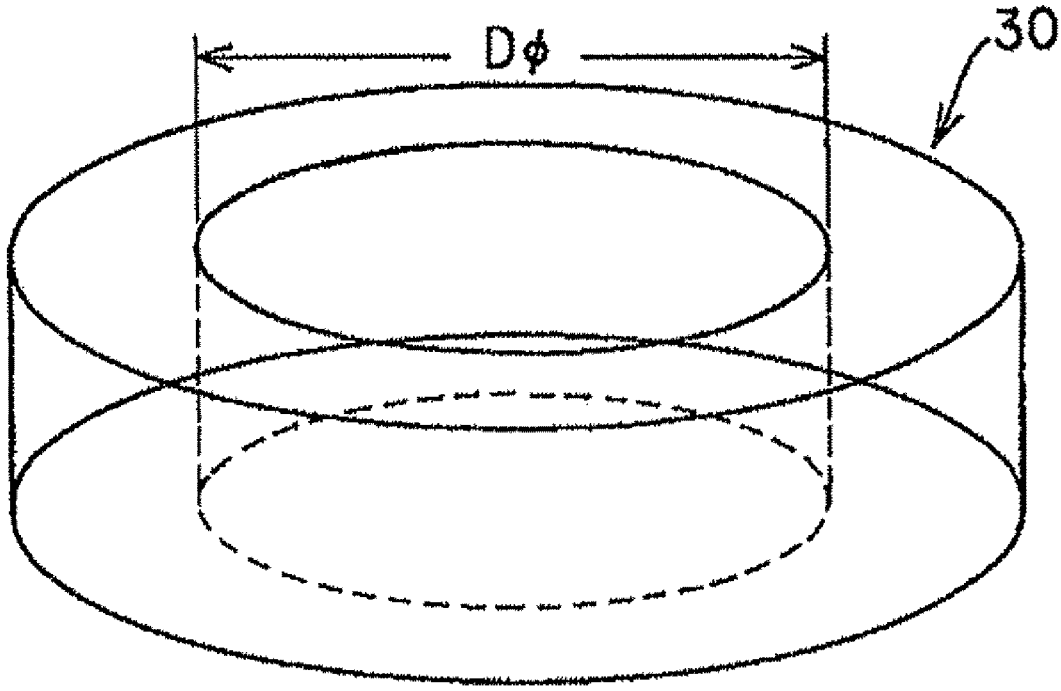
FIG. 4 is a perspective view of a master gauge used for the honing method in accordance with FIG. 3.

Referring now to FIG. 3, in step S1 the honing head 3 of the honing control device 1 is inserted into the gauge hole Dϕ of the master gauge 30. Then, the grinder rest 22 and grinder 2, which are incliningly contacted, are expanded toward the outer side of the diametric direction by extruding downwardly the push rod 8 and taper-shaped extrusion 23 by the delivery driving motor 9 as shown in step S2. According to the delivery amount of the delivery driving motor 9, a reading position by the motor encoder contained within the NC servo motor of the delivery driving motor 9 is fed back to the calculation control portion 15 as the NC data.

If the expanded grinder 7 contacts an inner surface of the gauge hole Dϕ of the master gauge 30, then a detected reaction force by the processing reaction force sensor 12 arranged between the outer peripheral grinder rest 22A and the inner peripheral grinder rest 22B is increased from a zero output to a desired pressure positive value input to the calculation control portion 15. The calculation control portion 15 stores the NC data of the delivery driving motor 9 at a point when the reaction force by the processing reaction force sensor 12 is output as an NC expansion target point. According to an increase of the detecting reaction force, the delivery driving motor 9 is stopped while the push rod 8, the extrusion 23 and the outer and inner peripheral grinder rests 22 are retracted, thereby returning to a standby position by reversely rotating the delivery driving motor 9. Thereafter, the process proceeds to step S3.

Further, the reaction force detected by the processing reaction force sensor 12 at the above point is generated when a mutual clearance among the push rod 8, extrusion 23 and outer/inner peripheral grinder rests is clogged. Compared to an actual processing reaction force, the detected reaction force is relatively small and does not generate any bending of the push rod 8 or deformation of the master gauge 30.

Then, as shown in step S3, the inner surface of the hole is honed by inserting the honing head 3 into the processing hole W1 formed in the workpiece W, contacting the grinder 7 with the inner surface of the processing hole W1 by operating the delivery driving motor 9 to thereby transmit the push rod 8, the extrusion 23 and the inner/outer grinder rests 22, and lifting the honing head 3 by the lift driving motor 4 while rotating the driving tube 2 and honing head 3 by the main axis rotary motor 6. According to the difference between the delivery amount (NC data) and NC expansion target point in the stage where the grinder 7 contacts the inner surface of the hole W1 of the workpiece W by the delivery driving motor 9 (an increasing step of the processing reaction force F), a delivery speed of the delivery driving motor 9 is established by establishing an appropriate delivery amount in the calculating control portion 15. By doing so, the grinder 7 is pressed in the inner surface of the hole W1. Further, the reading position by the motor encoder contained in the NC servo motor of the delivery driving motor 9 is fed back to the calculation control portion 15 as the NC data, while the processing reaction force is fed back from the processing reaction force sensor 12 to the calculation control portion 15.

The calculation control portion 15 computes a hole diameter of the processing hole W1 of the workpiece W based on the feedback reading position (NC data) by the motor encoder contained in the NC servo motor of the delivery driving motor 9, as well as the processing reaction force F from the processing reaction force sensor 12 in step S4.

The hole diameter computation of the processing hole W1 is calculated by adding a bending δ1 that occurs in the push rod 8 against the processing reaction force F detected by the processing reaction force sensor 12 and a deformation δ2 that occurs in the workpiece W into the reading position (NC data) by the motor encoder contained in the NC servo motor of the delivery driving motor 9.

Figure 5:
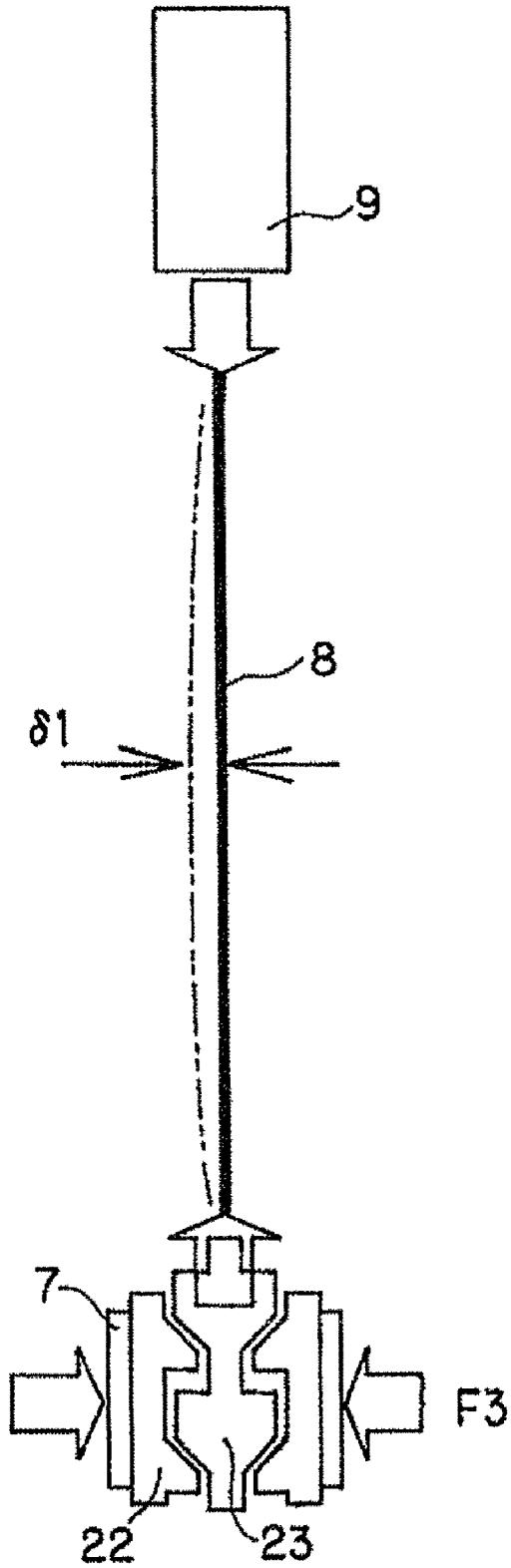
FIG. 5 is an explanatory view showing a mechanism for generating a push rod distortion $\delta 1$.
Figure 6:
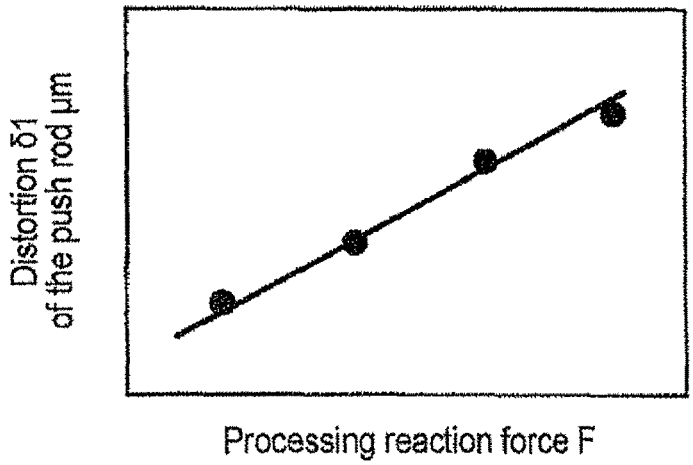
FIG. 6 is a characteristic view showing a relationship between a processing reaction force F and a push rod distortion amount $\delta 1$.

As shown in FIG. 5, if the processing reaction force F is exerted to the grinder 7 at the time of processing, a bending or distortion δ1 occurs in the push rod 8 by the exertion of the processing reaction force F. Accordingly, a difference calculated as [NC command value−retracting amount of the grinder by the distortion δ1=actual amount of the expanding movement] is generated between the NC command value to the delivery driving motor 9 and the actual amount of the expanding movement of the grinder 7. Such a distortion δ1 is generated proportional to the processing reaction force F as shown in FIG. 6. Thus, the actual amount of the expanding movement of the grinder 7 becomes a value based on subtracting the grinder retracting amount caused by the distortion δ1 of the push rod 8 generated by the processing reaction force F from the NC command value. In particular, if a cutting quality of the grinder 7 is low, or the processing NC command value is large (indicating a processing load is large), the distortion δ1 of the push rod 8 increases since the processing reaction force F is relatively increased. Thus, the difference between the NC command value and the actual amount of the expanding movement (diameter) becomes larger.

Figure 7:
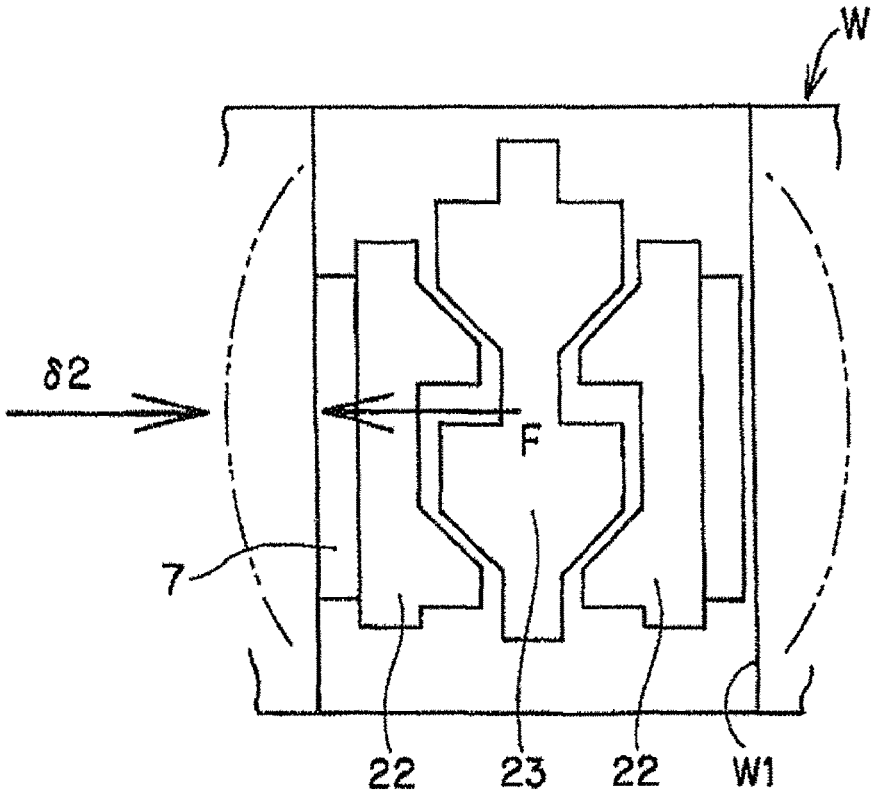
FIG. 7 is an explanatory view showing a deformation mechanism of a processing hole of a workpiece.
Figure 8:
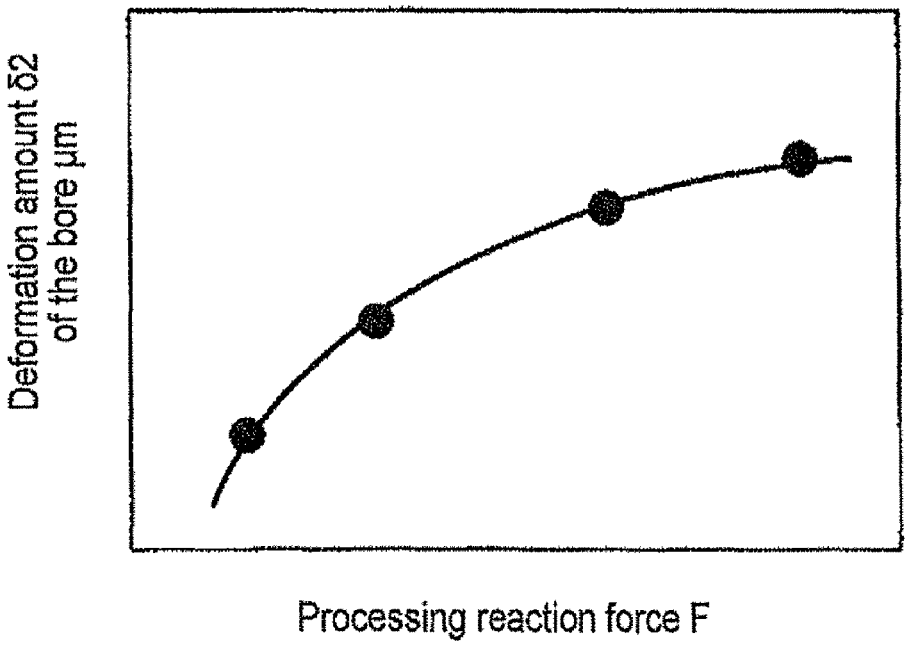
FIG. 8 is a characteristic view showing a relationship between the processing reaction force F and a bore deformation amount $\delta 2$.

Further, FIG. 7 shows a state of processing when the grinder 7 contacts the inner surface of the hole W1. As indicated in the two-dot chain line, the workpiece W is deformed toward an outer peripheral side (a direction of increasing the hole diameter) by the processing reacting force F from the grinder 7. As shown in FIG. 8, the deformation amount δ2 is increased proportional to the processing reaction force F. Thus, the actual amount of the expanding movement of the grinder 7 becomes a value based on subtracting an amount of the grinder advancement caused by the deformation amount δ2 of the workpiece W generated by the processing reaction force F from the NC command value. Also, in such a case, if the cutting quality of the grinder 7 is low, or the processing NC command value is large (indicating the processing load is large), the deformation amount δ2 of the workpiece W increases since the processing reaction force F is relatively increased. As such, the difference between the NC command value and the actual amount of the expanding movement (diameter) becomes larger Also, the deformation amount δ2 of the workpiece W against the processing reacting force F is also changed according to a shape of the workpiece W. For example, as to the honing of a cylinder bore of an engine, in a top deck formation where both ends of a cylinder forming the cylinder bore are connected to a cylinder block, the deformation amount δ2 tends to be relatively decreased in a region adjacent to an up-down deck and relatively increased in a center position as receding from the up-down deck toward an axial direction. Further, in the open deck formation, since the deformation amount δ2 tends to be increased in an upper end of the cylinder bore, the deformation amount δ2 is variously changed according to a connecting state of the cylinder by the cylinder block.

Thus, the hole diameter computation of the processing hole W1 is computed by subtracting the grinder retracting amount caused by the bending δ1 generated in the push rod 8 by the processing reaction force F detected by the processing reaction force sensor 12 and the bending δ2 generated in the workpiece W from the reading position (NC data) by the motor encoder contained in the NC servo motor of the delivery driving motor 9.

Referring again to FIG. 3, in step S5 the computed hole diameter of the processing hole W1 is compared to the NC expansion target point. When the NC expansion target point is not reached, the processes from S3 to S5 are repeated. When the hole W1 is created by a honing of the cylinder bore, as to all axial direction regions, such that the computed hole diameter of the processing hole W1 reaches the NC expansion target point, the process proceeds to step S6 to thereby end the honing. In step S6, the delivery amount by the delivery driving motor 9 is returned to an initial position, thereby stopping a rotation of the driving tube 2 by the main axis rotary motor 6, and the honing head 3 is extracted and raised from the processing hole W1 of the workpiece W by the lift driving motor 4. The deformation of the processing hole W1 of the workpiece W is returned as the processing reaction force F is removed to thereby obtain a target inner diameter. A processing accuracy of the obtained processing hole W1 of the workpiece W may form a diameter guarantee in the similar standard of a fine boring accuracy (tolerance 0.03 mm).

As described above, in each processing cycle of the workpiece W, since the target processing diameter of the honing control device 1 is established by the master gauge 30 and the hole inner surface formed in the workpiece is honed to have the established target processing diameter, an abrasion amount of the grinder following the honing of the cylinder bore per one cylinder block is within 1 μm. Thus, the diameter may become a level without any problems for an inner diameter after processing.

As such, as for the honing having a large processing area, for example, when a thin film thermal spray in a hard metal is performed in the inner surface of the cylinder bore of the cylinder block, since it is technically difficult to thin the thin metal thermal spray metal, high costs are required in addition to thinning. Thus, as a pre-work prior to performing the finish honing, it may be desirable to perform the honing of the present embodiment since it can utilize a determined numerical processing even in the case of a large processing amount.

In the present embodiment, the following effects can be obtained.

First, the honing method or honing control device 1 performs the honing while pressing the inner surface of the processing hole W1 by inserting the honing head 3 comprising the grinder 8 in the outer periphery into the processing hole W1 and expandingly moving the grinder 7 by the expansion members 8, 22 and 23 installed within the honing head 3. The processing reaction force sensor 12 is provided in the honing head 3 for detecting the processing reaction force generated in the grinder 7 against the processing hole W1 of the workpiece W. The amount of the expanding movement when the grinder 7 contacts the inner surface of the gauge hole Dϕ via the expansion member is stored as the target expansion amount by inserting the honing head 3 into the gauge hole Dϕ having the same size as the target processing diameter of the master gauge 30. Further, the honing of the inner surface of the processing hole W1 is performed by inserting the honing head 3 into the processing hole W1 of the workpiece W, thereby expandingly moving the grinder 7 toward the outer side of the diametrical direction by the expansion member installed within the honing head 3 to rotate the honing head 3. The honing is completed when the target expansion amount established by the master gauge 30 is reached by the value obtained by subtracting the grinder advancing amount caused by the deformation generated in the workpiece W according to the processing reaction force detected by the processing reaction force sensor 12 from the amount of the expanding movement of the grinder. As such, even in the case of the honing having a large processing area, it is possible to implement honing with a target inner diameter since it becomes possible to measure the diameter of the processing hole W1 of the workpiece W. Further, since an error caused by the deformation generated in the workpiece W by the processing reaction force is resolved, the honing diameter of the processing hole W1 of the workpiece can become close to the target processing diameter with high accuracy.

Second, the processing reaction force sensor 12 is provided in the honing head 3 for detecting the processing reaction force generated in the grinder 7 against the processing hole W1 of the workpiece W. The honing ends when a value obtained by subtracting the grinder retracting amount caused by the distortion generated within the expansion member according to the processing reaction force detected by the processing reaction force sensor 12 from the amount of the expanding movement of the grinder 7 reaches the target expansion amount established by the master gauge 30. Accordingly, since an error caused by the distortion generated within the expansion member by the processing reaction force is resolved, the honing diameter of the processing hole W1 of the workpiece W can become close to the target processing diameter with high accuracy.

Third, the expansion member includes the delivery driving motor 9 formed of the NC servo motor, the push rod 8 for transferring the delivery amount of the NC servo motor to the honing head 3 and the extrusion 23 for transmitting the grinder 7 from the honing head 3 along the radial direction according to the moving amount of the push rod 8 and the grinder rest 22. Consequently, it is possible to easily determine the delivery control amount based on the output value by the motor encoder of the NC servo motor and to easily reduce the effect by the bending of the push rod 8 from the output value of the encoder.

FIGS. 9A to 13 show a second embodiment of the honing method and honing control device of the invention. In the present embodiment, a honing diameter becomes closer to a target processing diameter with high accuracy in consideration of a cutting quality of a honing grinder.

Figure 9A:
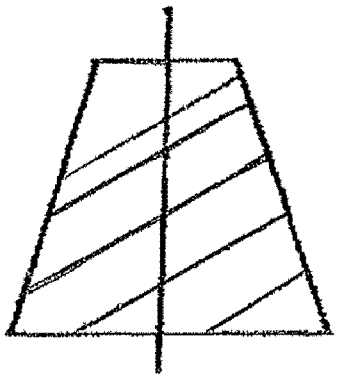
FIG. 9A is a front view showing a shape of a grinder used in a honing control device in accordance with a second embodiment of the invention.
Figure 9B:
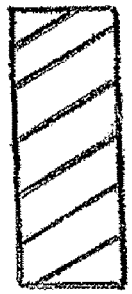
FIG. 9B is a side view showing the shape of the grinder according to FIG. 9A.

The honing control device 1 of the present embodiment is constituted similarly to the honing control device of the first embodiment so duplicative descriptions are omitted. Further, as shown in FIGS. 9A and 9B, the grinder 7 mounted on the honing head 3 is in the shape of a trapezoid wherein a thickness in a diametrical direction is constant but a width becomes larger proceeding to a leading end side of the honing head 3. According to such a shape, since it is not possible to sufficiently secure a cutting amount of a lower end of the hole W1, it is difficult to cut the lower end of the hole W1. Thus, the problem can be solved where the hole W1 tends to become a shape having a shrunken lower end.

Further, although it is not illustrated, for a grinder 7 having a constant width size, a short stroke (decreasing the speed of a delivery operation) or dwell operation is performed so as to actively cut a lower end portion of a bore. The dwell operation means that in a mechanical processing, the tool rotary motion is processed with stopping the tool feed motion, and the workpiece is contacted by a blade end of the tool. In the honing of the cylinder bore, in order to actively cut the lower end portion of the bore, an up-down stroke (delivery) operation of the honing head is temporarily stopped in the lower end. As a result, the time of contacting the blade end (honing grinder 7) in the lower end (i.e., a work operation amount) is relatively increased so that the problem can be solved where the cylinder bore tends to have the lower end in a shrunken shape.

However, in the present embodiment, a deterioration of the processing conditions such as an increase of the cycle time or by the short stroke or dwell operation or grinder piece abrasion is improved by adopting the shape of the grinder 7 as a trapezoid.

Further, in the honing method, although the amount of the expanding movement of the grinder 7 is the same, a completed diameter of the hole W1 varies depending on the cutting quality of the grinder 7 performing the honing. That is, FIG. 10 has a horizontal axis including an amount of the expanding movement of the grinder 7 and a vertical axis with a diameter size of the processing hole W1 of the workpiece W. When the cutting quality of the grinder 7 is high, as for the diameter size of the processing hole W1 compared to the amount of the expanding movement of the grinder 7, an inclined grade thereof rapidly rises as indicated by Line A in FIG. 10. However, when the cutting quality is low, the inclined grade thereof does not rapidly rise as indicated by Line C in FIG. 10. Further, Line B in FIG. 10 indicates the diameter size of the processing hole W1 compared to the amount of the expanding movement of the grinder 7 by a grinder having a standard stable cutting quality.

The honing method of the present embodiment is devised by adopting the above cutting quality of the grinder 7. That is, when the cutting quality of the grinder 7 is high, the amount of the expanding movement of the grinder 7 for processing the processing hole W1 to have the target processing diameter is decreased. However, when the cutting quality of the grinder 7 is low, the amount of the expanding movement of the grinder 7 is increased.

Further, to judge the cutting quality of the grinder 7, the honing is started. In an intermediate stage where the amount of the expanding movement of the grinder 7 reaches an intermediate expansion moving amount X, which is previously established, the honing is stopped, and the honing grinder 7 is retracted and separated from a surface of the hole W1. Then, an actual diameter size of the processing hole W1 is measured. By doing so, a processing hole size compared to the amount of the expanding movement of the grinder, i.e., a cutting quality of the grinder 7, is judged. Also, a target expansion amount that is equal to the intermediate amount of the expanding movement X and a residual amount of the expanding movement, which reaches the target processing diameter by the honing thereafter, is established according to the cutting quality of the grinder 7.

Figure 10:
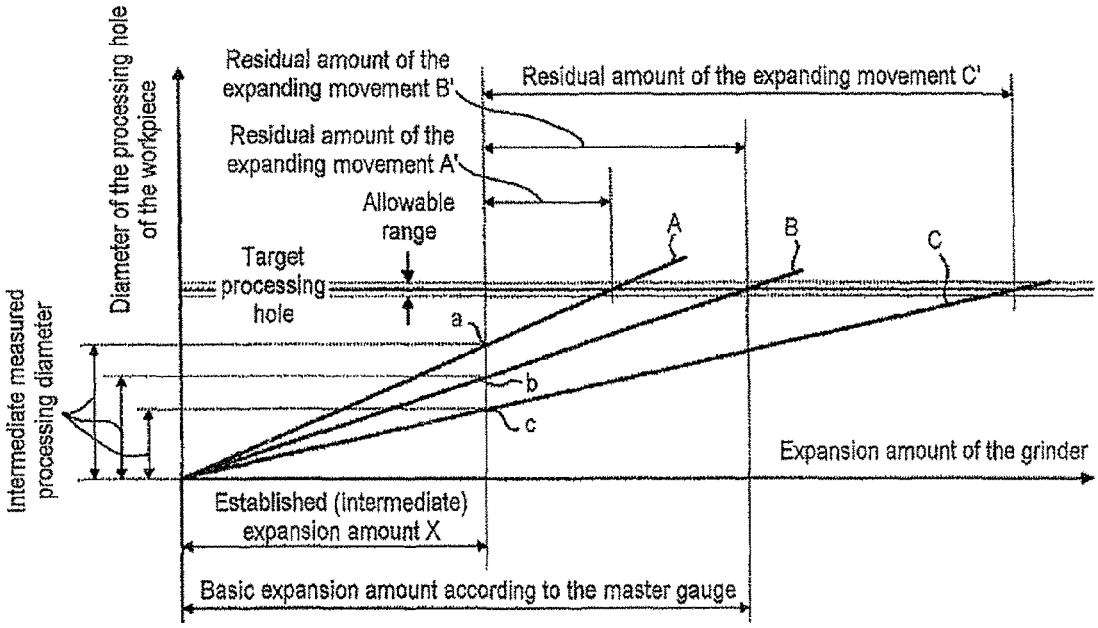
FIG. 10 is a characteristic view showing a data table of a target processing diameter according to a cutting quality of a grinder and an amount of an expanding movement of the grinder in accordance with embodiments of the invention.

To achieve this goal, in the honing method of the present embodiment, a data table is prepared before the honing by corresponding each grinder 7 with a preferable (i.e., high) cutting quality (Line A), a poor cutting quality (Line C) or a plurality of cutting qualities between these two. (In FIG. 10, there is only one type of grinder 7 with a standard cutting quality as shown by Line B.) More specifically, a data table is prepared by measuring the size of the processing hole of the workpiece obtained by honing previously performed by using a plurality of grinders 7 with different cutting qualities. As shown in FIG. 10, such a data table of processing hole diameter compared to amount of the expanding movement of the grinder 7 may be a characteristic diagram indicating the diameter of the processing hole against the amount of the expanding movement of the grinder 7, or data files of the target expansion amount regarding the measured diameter of the intermediate processing hole against the previously established (intermediate) amount of the expanding movement X and the target expansion amount against the target diameter of the processing hole.

Figure 11:
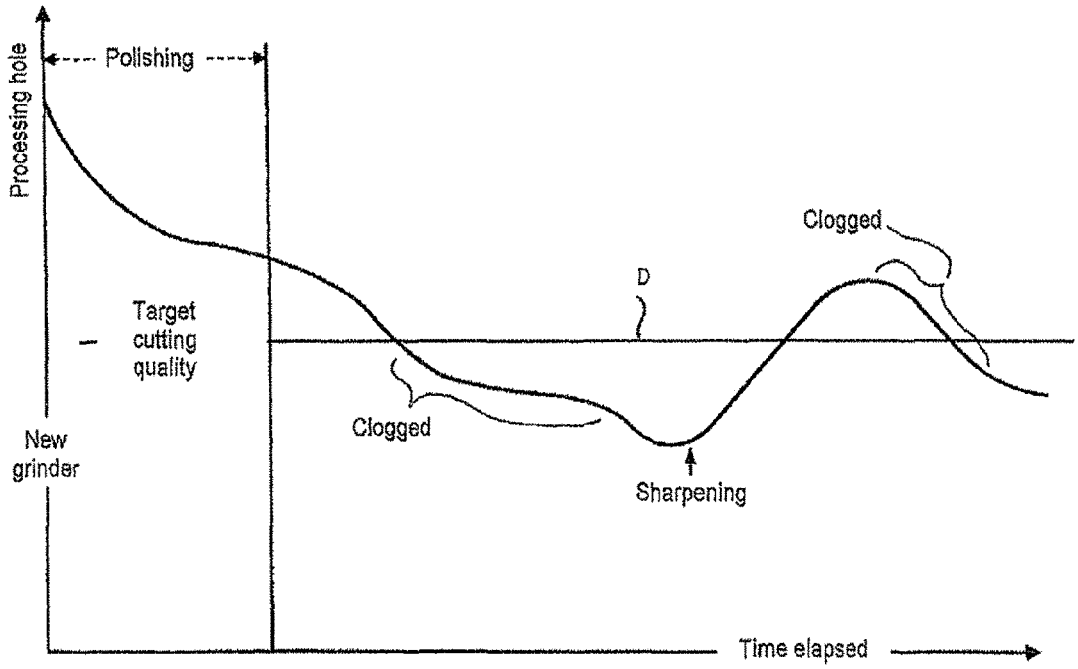
FIG. 11 is a time chart showing a cutting quality change of the grinder.

FIG. 11 shows cutting quality changes of the grinder with a time elapsed depending on the changes of the diameter size of the processing hole W1 to be processed according to the amount of the expanding movement of the same grinder 7. Further, D indicates an average (that is, a target cutting quality) of the cutting quality of the grinder 7.

As shown in FIG. 1, when the grinder 7 is new the cutting quality is high. Further, a stable cutting quality is obtained during polishing by a desired number of work processes. However, in addition to the work process, the cutting quality gradually deteriorates. This is because the cutting scraps of the workpiece W or crushed grinder particle powders are inserted between the grinder particles. Further, as for the grinder 7 whose cutting quality is deteriorated, the cutting quality thereof is recovered by removing the cutting scraps of the workpiece W or crushed grinder particle powders inserted between the grinder particles by sharpening the grinder 7 with a soft truing tool.

As described above, the cutting quality of the typical grinder 7 is gradually changed by sharpening the grinder 7 or clogging the spaces among the grinder particles. Thus, it is preferred that a cutting quality establishment of the grinder by the data table of "processing hole diameter" to "amount of the expanding movement" is renewed in every honing for a desired number of the workpieces W. As such, the honing method of the present embodiment includes a honing method shown in FIG. 12 for establishing the cutting quality of honing the workpiece W while checking the quality of the grinder 7 in use and a honing method shown in FIG. 13 wherein the cutting quality is established of honing the workpiece W by the grinder 7 wherein the cutting quality is established. According to the former honing method, the total honing cycle time can be reduced while maintaining the accuracy of the diameter size of the honing hole W1 by performing the former method whenever the latter honing method is performed in a plurality of cycle times.

Figure 12:
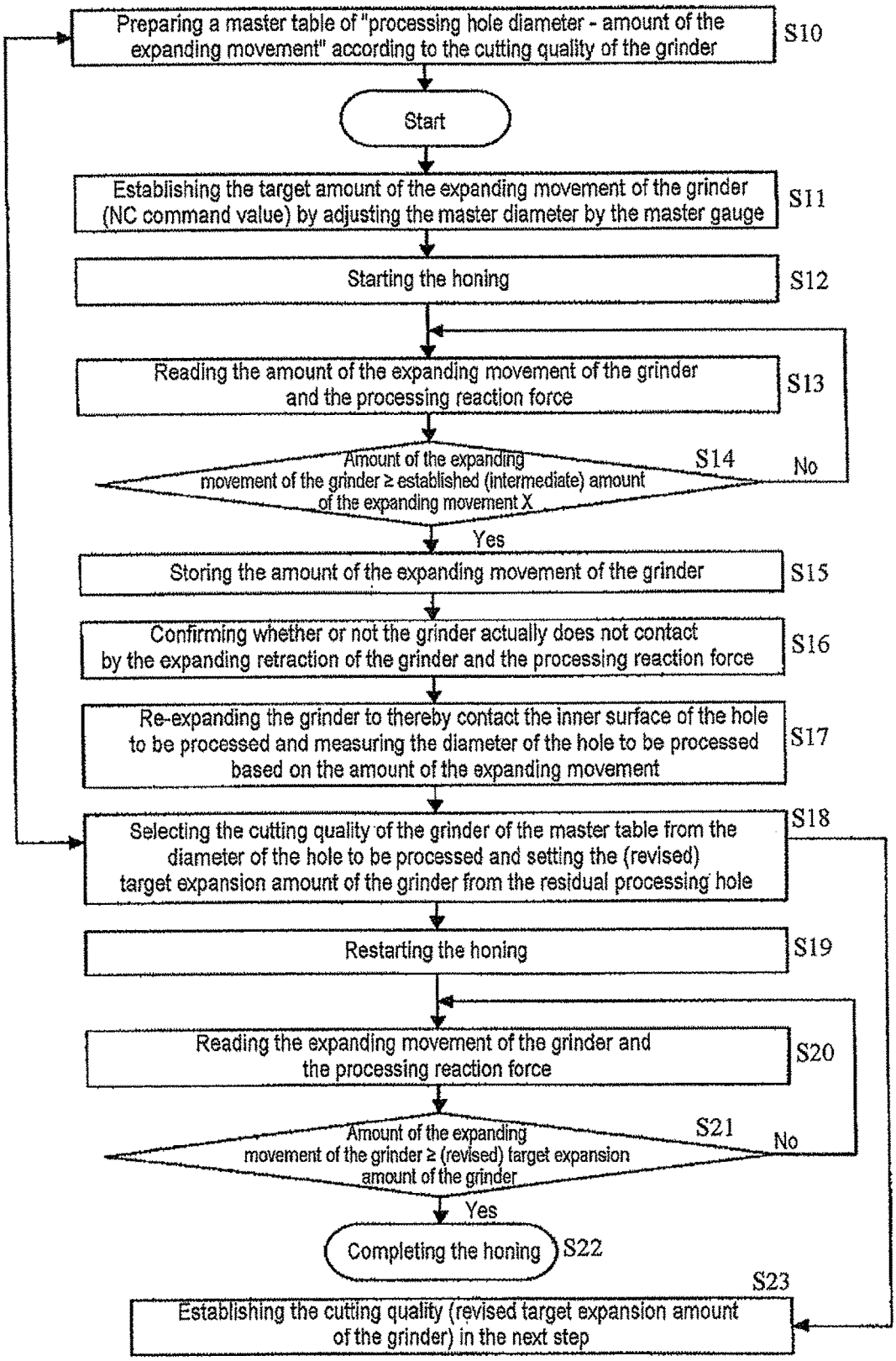
FIG. 12 is a block diagram showing the order of the honing method in accordance with the second embodiment.

According to the honing method for establishing the cutting quality shown in FIG. 12, in step S10 the data table of "processing hole diameter" to "amount of the expanding movement" shown in FIG. 10 is first prepared by corresponding to a first grinder 7 with a high cutting quality (Line A), a second grinder 7 with a poor cutting quality (Line C) and a grinder 7 with a plurality of cutting qualities between the above two grinders.

Then, in step S11 the honing head 3 of the honing control device 1 is inserted into the gauge hole Dϕ of the master gauge 30. Then, the grinder rest 22 and grinder 7, which are incliningly contacted, are expanded toward the outer side of the diametric direction by extruding downwardly the push rod 8 and taper-shaped extrusion 23 by the delivery driving motor 9. According to the delivery amount of the delivery driving motor 9, a reading position by the motor encoder contained within the NC servo motor of the delivery driving motor 9 is fed back to the calculation control portion 15 as the NC data.

If the expandingly-moved grinder 7 contacts an inner surface of the gauge hole Dϕ of the master gauge 30, then a detecting reaction force by the processing reaction force sensor 12 arranged between the outer peripheral grinder rest 22A and the inner peripheral grinder rest 22B increases from a zero power to a desired positive pressure value to thereby be input to the calculation control portion 15. The calculation control portion 15 stores the NC data (reading position) of the delivery driving motor 9 at a point when the reaction force by the processing reaction force sensor 12 is output as a NC expansion target point. According to an increase of the detecting reaction force, the delivery driving motor 9 stops while the push rod 8, the extrusion 23 and the outer and inner peripheral grinder rests 22 are retracted to thereby return to a standby position by reversely rotating the delivery driving motor 9. Then, the process proceeds to step S12.

Further, the reaction force detected by the processing reaction force sensor 12 at the above point is generated when a mutual clearance among the push rod 8, extrusion 23 and outer/inner peripheral grinder rests is clogged. Compared to an actual processing reaction force, the detected reaction force is relatively small and does not generate a bending of the push rod 8 or deformation of the master gauge 30.

Then, as shown in step S12, the honing head 3 is inserted into the processing hole W1 formed in the workpiece W, and the grinder 7 contacts the inner surface of the processing hole W1 by operating the delivery driving motor 9 to thereby transmit the push rod 8, the extrusion 23 and the inner/outer grinder rests 22. Further, the inner surface of the hole W1 is honed by lifting the honing head 3 by the lift driving motor 4 while rotating the driving tube 2 and honing head 3 by the main axis rotary motor 6. According to the difference between the delivery amount (NC data) and NC expansion target point when the grinder 7 contacts the inner surface of the hole W1 using the delivery driving motor 9 (an increasing step of the processing reaction force F), the delivery speed of the delivery driving motor 9 is determined by establishing an appropriate delivery amount in the calculating control portion 15. By doing so, the grinder 7 is pressed in the inner surface of the hole W1. Further, the reading position (amount of the expanding movement of the grinder 7) by the motor encoder contained in the NC servo motor of the delivery driving motor 9 is fed back to the calculation control portion 15 as the NC data, while the processing reaction force is fed back from the processing reaction force sensor 12 to the calculation control portion 15 as shown in step S13.

In step S14 the process determines whether or not the amount of the expanding movement of the grinder read in step S13 reaches the previously established (intermediate) amount of the expanding movement X. If the amount of the expanding movement of the grinder does not reach the established (intermediate) amount of the expanding movement X, then the processes of steps S13 and S14 are repeated. When the hole to be processed W1 is a honing of the cylinder bore, as to all axial direction regions, the process proceeds to step S15 when the computed amount of the expanding movement of the grinder reaches the established (intermediate) amount of the expanding movement X.

In step S15 the expanding movement of the grinder stops, and the amount of the expanding movement X of the grinder 7 at this time is stored. Then, the process proceeds to step S16.

In step S16 the grinder 7 retracts by a certain amount to a position where the grinder 7 does not contact the inner surface of the workpiece. Further, the processing reaction force sensor 12 confirms whether or not the grinder 7 actually does not contact the inner surface of the hole W1 of the workpiece W. If the grinder still contacts the inner surface, the grinder 7 is retracted for a distance again. Since a contacting state of the grinder 7 and the inner surface of the hole W1 is released, the distortion of the workpiece W and the bending of the push rod 8 made at the time of processing are removed.

In step S17 the grinder 7 expandingly moves again and stops at a point when the output of the processing reaction force sensor 12 increases, thereby indicating contact of the grinder 7 with the processing hole W1. The processing reaction force sensor 12 outputs the amount of the expanding movement of the grinder 7 at this point to the calculating control portion 15. The calculating control portion 15 measures an actual diameter of the processing hole W1 of the workpiece W (providing an intermediated diameter of the measured processing hole) based on the amount of the expanding movement of the grinder 7 at the input point. According to the cutting quality of the grinder 7, the actual diameter of the processing hole against the established (intermediate) amount of the expanding movement X changes by an affect of the distortion of the workpiece W and the bending of the push rod 8 made at the time of processing.

In step S18, cutting quality of the grinder 7 is selected from the actual diameter of the processing hole W1 based on the amount of the expanding movement X of the grinder stored in step S14 using the data table of "processing hole diameter" to "amount of the expanding movement." That is, as to the established (intermediate) amount of the expanding movement X of the grinder 7 in FIG. 10, for example, the cutting quality has characteristic A when the measured diameter of the intermediate processing hole is a size "a." When the measured diameter of the intermediate processing hole is a size "b," the cutting quality has characteristic B. Further, when the measured diameter of the intermediate processing hole is a size "c," the cutting quality has characteristic C. Also, the cutting quality of the grinder 7 in the honing is revised for the next step in step S23 to be the above determined cutting quality (or the revised target expansion amount).

Further, using the cutting quality characteristic of the grinder 7 established by the amount of the expanding movement (that is, the established amount of the expanding movement X) of the grinder 7 stored in step S15 and the measured diameter of the intermediate processing hole, an amount of an expanding movement of a residual grinder to the target diameter of the processing hole is calculated based on the data table of "processing hole diameter" to "amount of the expanding movement." That is, in FIG. 10 the residual amount of the expanding movement is established as A' when the cutting quality of the grinder 7 is A. When the cutting quality of the grinder 7 is B, the residual amount of the expanding movement is established as B'. Further, when the cutting quality of the grinder 7 is C, the residual amount of the expanding movement is established as C'. Thus, the (revised) target expansion amount to reach the target diameter of the processing hole is established according to the cutting quality characteristics of the grinder 7 as (X+A') in the case of characteristic A, (X+B') in the case of characteristic B, etc. Further, X indicated the established (intermediate) amount of the expanding movement in step S14.

In step S19 the grinder 7 contacts the inner surface of the processing hole W1 again by transmitting the push rod 8, the extrusion 23 and the inner/outer grinder rests 22 using the delivery driving motor 9, and the honing head 3 is lifted by the lift driving motor 4 while rotating the driving tube 2 and honing head 3 by the main axis rotary motor 7, thereby restarting the honing. According to the difference between the delivery amount (NC data) and NC expansion target point in the stage where the grinder 7 contacts the inner surface of the hole W1 of the workpiece W by the delivery driving motor 9 (an increasing step of the processing reaction force F), the delivery speed of the delivery driving motor 9 is established by an appropriate delivery amount in the calculating control portion 15. By doing so, the grinder 7 is pressed in the inner surface of the hole W1. Further, the reading position (i.e., amount of the expanding movement of the grinder) by the motor encoder contained in the NC servo motor of the delivery driving motor 9 is fed back to the calculation control portion 12 as the NC data, while the processing reaction force is fed back from the processing reaction force sensor 12 to the calculation control portion 15 as shown in step S20.

In step S21 the process determines whether or not the amount of the expanding movement of the grinder in step S20 reaches the (revised) target amount of the expanding movement established in step S18. If the amount of the expanding movement of the grinder does not reach the (revised) target amount of the expanding movement, then the processes of steps S20 and S21 are repeated. When the hole W1 is a honing of the cylinder bore, as to all axial direction regions, where the computed amount of the expanding movement of the grinder 7 reaches the (revised) target amount of the expanding movement, the process proceeds to step S22.

In step S22, the delivery amount by the delivery driving motor 9 returns to an initial position, thereby stopping the rotation of the driving tube 2 by the main axis rotary motor 6. Further, the honing head 3 is extracted and raised from the processing hole W1 of the workpiece W by the lift driving motor 4. By doing so, the honing in this process is completed.

Figure 13:
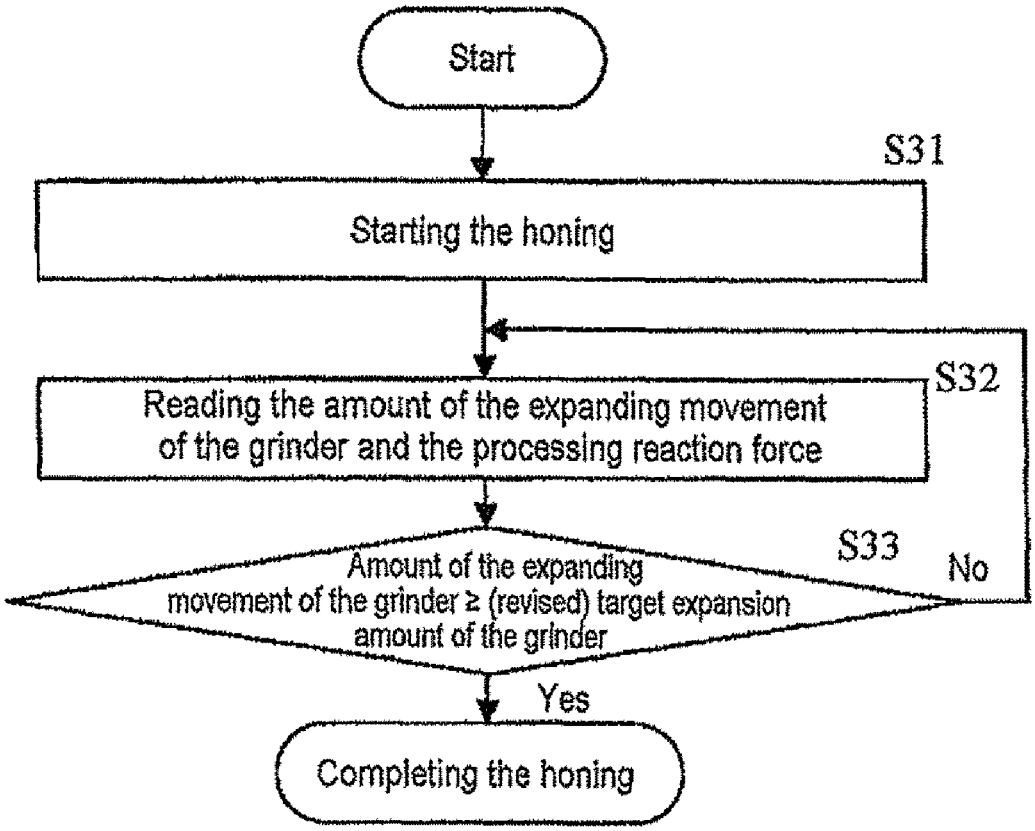
FIG. 13 is a block diagram showing the order of the honing method in a plurality of processes inserted between the honing methods shown in FIG. 12.

According to the honing method wherein the cutting quality is established shown in FIG. 13, in step 31 the honing head 3 is inserted into the processing hole W1 formed in the workpiece W and the grinder 7 again contacts the inner surface of the processing hole W1 by operating the delivery driving motor 9 to thereby transmit the push rod 8, the extrusion 23 and the inner/outer grinder rests 22. Further, the honing on the inner surface of the hole starts by lifting the honing head 3 by the lift driving motor 4 while rotating the driving tube 2 and honing head 3 by the main axis rotary motor 6. According to the difference between the delivery amount (NC data) and NC expansion target point when the grinder 7 contacts the inner surface of the hole W1 using the delivery driving motor 9 (an increasing step of the processing reaction force F), the delivery speed of the delivery driving motor 9 is established by an appropriate delivery amount in the calculating control portion 15. By doing so, the grinder 7 is pressed in the inner surface of the hole W1. Further, the reading position (i.e., amount of the expanding movement of the grinder 7) by the motor encoder contained in the NC servo motor of the delivery driving motor 9 is fed back to the calculation control portion 12 as the NC data, while the processing reaction force is fed back from the processing reaction force sensor 12 to the calculation control portion 15 as shown in step S32.

In step S33 the process determines whether or not the amount of the expanding movement of the grinder 7 reaches the (revised) target expansion amount based on the cutting quality of the grinder 7 established in step S23. Also, when the amount of the expanding movement of the grinder 7 does not reach the (revised) target expansion amount, the processes of steps S32 and S33 are repeated. Further, when the hole W1 is a honing of the cylinder bore, as to all axial direction regions, where the computed amount of the expanding movement of the grinder 7 reaches the (revised) target amount of the expanding movement, the process proceeds to step S34.

In step S34 the delivery amount by the delivery driving motor 9 returns to an initial position, thereby stopping the rotation of the driving tube 2 by the main axis rotary motor 6. The honing head 3 is extracted and raised from the processing hole W1 of the workpiece W by the lift driving motor 4. By doing so, the honing in this process is completed.

When the honing method for establishing the cutting quality shown in FIG. 12 is performed in every honing, the cutting quality of the grinder 7 used in this honing can be revised every time so the accuracy and roundness of the diameter of the hole to be processed after the honing can be improved.

Further, as for the honing method shown in FIG. 13 wherein the cutting quality is established and the honing method shown in FIG. 12 for establishing the cutting quality, since the latter honing is performed whenever the former honing is performed, the honing methods can be performed after sharpening the grinder 7 in use or replacing the grinder 7. Since the cutting quality of the grinder 7 in use can be revised every time in such methods, the accuracy and roundness of the diameter of the hole to be processed after the honing can be improved while the processing cycle time is reduced.

In addition to the effects of the first embodiment, the following effects can be obtained by the second embodiment.

In the intermediate stage where the amount of the expanding movement of the grinder 7 reaches the target expansion amount established by the master gauge 30, since the diameter of the processing hole in the intermediate stage obtained by the honing is measured and the target expansion amount is revised based on that diameter compared to the amount of the expanding movement of the grinder 7, changes to the diameter of the hole to be processed compared to the amount of the expanding movement of the grinder 7, which is changed according to the cutting quality of the grinder 7, can be revised. This improves the accuracy of the diameter of the processing hole that is honed.

Also, a data table is prepared wherein a plurality of correlations between the diameter of the hole to be processed against the amount of the expanding movement of the grinder 7 is stored corresponding to changes of the cutting quality of the grinder 7. The revision of the target expansion amount is performed based on the correlation between the diameter of the hole to be processed against the amount of the expanding movement of the grinder 7 according to the cutting quality of the grinder 7 selected from the data table and based on the diameter of the processing hole in the intermediate stage. As such, the fluctuations of the diameter of the hole to be processed against the amount of the expanding movement of the grinder according to the changes of the cutting quality of the grinder 7 can be revised. Thus, the accuracy of the diameter of the hole to be processed can be improved.

Since the diameter of the hole to be processed in the intermediate stage is measured when the grinder 7 of the honing head 3 is retracted and separated from the inner surface of the hole W1, the distortion of the workpiece W and the bending of the push rod 8 made at the time of processing can be removed, and the remaining workpiece can be stably performed. Thus, the accuracy of the completed workpiece can be improved.

Further, and as to the honing for the workpiece W in a plurality of processes after completing the honing wherein the target expansion amount is revised, since the honing is performed based on the revised target expansion amount, the measurement of the diameter of the hole to be processed in the intermediate stage can be omitted during the honing in a plurality of the processes wherein the changes of the cutting quality of the grinder 7 used in the honing do not become great. Thus, even when the judgment of the cutting quality of the grinder 7 is performed in every honing the processing cycle time can be reduced.

In this embodiment, the grinder 7 is formed in the shape of the trapezoid where the width becomes wider as it approaches the leading end side of the honing head 3. In this regard, since it is not possible to sufficiently secure the cutting amount of the lower end of the hole W1 to be processed, it is difficult to cut the lower end of the hole W1 to be processed. Thus, the problem can be solved where the lower end of the hole W1 tends to have a shrunken shape. Further, since the roundness of the completed hole W1 can be secured, the deterioration of the processing conditions such as an increase of a cycle time or by the short stroke or dwell operation or piece abrasion of the grinder 7 can be improved.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A method of honing a workpiece having a hole to be processed by inserting a honing head with a grinder at an outer periphery thereof into the hole and moving the grinder towards an outer side of a diametrical direction of the honing head with an expansion member installed within the honing head to press an inner surface of the hole, the method comprising:

storing an amount of an expanding movement as a target expansion amount determined when the honing head is inserted into a gauge hole of a master gauge having a same size as a target processing diameter and the grinder contacts an inner surface of the gauge hole with the expansion member;

honing an inner surface of the hole by inserting the honing head into the hole, moving the grinder towards the outer side of the diametrical direction with the expansion member installed within the honing head, and rotating the honing head; and completing the honing when a value obtained by subtracting an amount of an advancement of the grinder based on a distortion of the workpiece generated by a processing reaction force of the grinder against the hole from the amount of the expanding movement of the grinder reaches the target expansion amount established using the master gauge.

2. The method according to claim 1 wherein completing the honing further comprises:

completing the honing when a value obtained by subtracting an amount of a retraction of the grinder based on a distortion of the expansion member generated by the processing reaction force from the amount of the expanding movement of the grinder reaches the target expansion amount established using the master gauge.

3. The method according to claim 1, further comprising:

measuring a diameter of the hole obtained by the honing in an intermediate stage wherein the amount of the expanding movement of the grinder reaches the target expansion amount established using the master gauge; and revising the target expansion amount based on the diameter of the hole in the intermediate stage compared to the amount of the expanding movement of the grinder.

4. The method according to claim 3, further comprising:

providing a data table storing correlations between diameters of the hole and respective amounts of the expanding movement of the grinder, the correlations corresponding to changes of cutting quality of the grinder; and wherein revising the target expansion amount includes revising the target expansion amount based on the correlations between the diameters and the respective amounts of the expanding movement of the grinder according to the cutting quality of the grinder selected from the data table based on the diameter of the hole in the intermediate stage.

5. The method according to claim 3 wherein measuring the diameter of the hole in the intermediate stage comprises:

retracting the grinder of the honing head after a distortion in the workpiece or a tool is removed from an inner surface of the hole; and contacting the grinder with the inner surface of the hole thereafter.

6. The method according to claim 3 wherein a second honing for the workpiece after completing the honing using the revised target expansion amount as the target expansion amount.

7. The method according to claim 1 wherein the grinder is in a shape of a trapezoid where a width becomes wider approaching a leading end side of the honing head.

8. A honing control device for performing a honing process wherein a honing head with a grinder at an outer periphery thereof is inserted into a hole of a workpiece and the grinder moves towards an outer side of a diametrical direction of the honing head with an expansion member installed within the honing head to press an inner surface of the hole, the device comprising:

means for detecting a processing reaction force of the grinder against the hole, the means installed on the honing head;

means for storing an amount of an expanding movement as a target expansion amount when the honing head is inserted into a gauge hole of a master gauge having a same size as a target processing diameter and the grinder contacts an inner surface of the gauge hole with the expansion member; and control means for determining a completion of the honing when a value obtained by subtracting an amount of advancement of the grinder based on a distortion along a radial direction of the workpiece generated by the processing reaction force from the amount of the expanding movement of the grinder reaches the target expansion amount established using the master gauge in the honing process wherein the honing head is inserted within the hole of the workpiece.

9. The honing control device according to claim 8 wherein the control means comprises:

means for determining the completion of the honing when a value obtained by subtracting an amount of retraction of the grinder based on a distortion of the expansion member generated by the processing reaction force from the amount of the expanding movement of the grinder reaches the target expansion amount established using the master gauge.

10. The honing control device according to claim 8 wherein the expansion member comprises:

a delivery driving motor including an NC servo motor;

a push rod for transferring the delivery amount of the NC servo motor to the honing head;

an extrusion; and a grinder rest for transmitting the grinder from the honing head along the radial direction according to a moving amount of the push rod; and wherein the distortion of the expansion member is a bending of the push rod.

11. The honing control device according to claim 8, further comprising:

measuring means for measuring a diameter of the hole obtained by the honing in an intermediate stage wherein the amount of the expanding movement of the grinder reaches the target expansion amount established using the master gauge; and wherein the control means further comprises means for revising the target expansion amount based on the diameter of the hole in the intermediate stage compared to the amount of the expanding movement of the grinder.

12. The honing control device according to claim 11, further comprising:

a data table configured to store correlations between diameters of the hole and respective amounts of the expanding movement of the grinder, the correlations corresponding to changes of cutting quality of the grinder; and wherein the means for revising the target expansion amount includes means for revising the target expansion amount based on the correlations according to the cutting quality of the grinder of the data table based on the diameter of the hole in the intermediate stage.

13. The honing control device according to claim 11 wherein the measuring means is configured to measure the diameter of the hole in the intermediate stage by retracting the grinder of the honing head after a distortion in the workpiece or a tool is removed from the inner surface of the hole and contacting the grinder with the inner surface of the hole thereafter.

14. The honing control device according to claim 11 wherein the control means is configured to perform a second honing for the workpiece after completing the honing using the revised target expansion amount as the target expansion amount.

15. The honing control device according to claim 8 wherein the grinder is in a shape of a trapezoid having a width becoming wider approaching a leading end side of the honing head.

* * * * *